US008454303B2

(12) United States Patent
Garcia-Crespo

(10) Patent No.: US 8,454,303 B2
(45) Date of Patent: Jun. 4, 2013

(54) TURBINE NOZZLE ASSEMBLY

(75) Inventor: Andres Jose Garcia-Crespo, Greenville, SC (US)

(73) Assignee: General Electric Company, Schenectady, NY (US)

( * ) Notice: Subject to any disclaimer, the term of this patent is extended or adjusted under 35 U.S.C. 154(b) by 690 days.

(21) Appl. No.: 12/687,407

(22) Filed: Jan. 14, 2010

(65) Prior Publication Data

US 2011/0171018 A1 Jul. 14, 2011

(51) Int. Cl.
*F01D 9/04* (2006.01)

(52) U.S. Cl.
USPC ..... 415/137; 415/139; 415/195; 415/209.4; 415/210.1

(58) Field of Classification Search
USPC ..... 415/134, 136, 137, 142, 195, 209.3, 415/209.4, 210.1; 416/175; 29/889.21
See application file for complete search history.

(56) References Cited

U.S. PATENT DOCUMENTS

| | | | | |
|---|---|---|---|---|
| 924,546 | A * | 6/1909 | Emmet | 416/191 |
| 3,542,484 | A * | 11/1970 | Mason | 415/160 |
| 4,013,377 | A * | 3/1977 | Amos | 415/161 |
| 4,385,864 | A * | 5/1983 | Zacherl | 415/136 |
| 4,396,349 | A * | 8/1983 | Hueber | 415/115 |
| 5,083,900 | A * | 1/1992 | Carletti et al. | 415/209.3 |
| 5,217,347 | A * | 6/1993 | Miraucourt et al. | 415/115 |
| 5,494,404 | A * | 2/1996 | Furseth et al. | 415/209.3 |
| 5,584,652 | A | 12/1996 | Shaffer et al. | |
| 5,591,003 | A * | 1/1997 | Boyd et al. | 415/209.2 |
| 5,634,768 | A * | 6/1997 | Shaffer et al. | 415/137 |
| 5,740,674 | A * | 4/1998 | Beutin et al. | 60/226.1 |
| 5,871,333 | A * | 2/1999 | Halsey | 415/173.1 |
| 6,409,473 | B1 * | 6/2002 | Chen et al. | 415/191 |
| 6,450,766 | B1 * | 9/2002 | Honda | 415/191 |
| 6,464,456 | B2 * | 10/2002 | Darolia et al. | 415/134 |
| RE39,479 | E * | 1/2007 | Tressler et al. | 415/115 |
| 7,448,851 | B2 * | 11/2008 | Bolgar et al. | 415/173.7 |
| 7,695,244 | B2 * | 4/2010 | Au | 415/174.4 |
| 2003/0082051 | A1 * | 5/2003 | Bertrand et al. | 415/209.3 |
| 2011/0171018 | A1 * | 7/2011 | Garcia-Crespo | 415/208.2 |
| 2012/0301285 | A1 * | 11/2012 | Suciu et al. | 415/191 |

FOREIGN PATENT DOCUMENTS

GB 2425155 A * 10/2006

* cited by examiner

*Primary Examiner* — Edward Look
*Assistant Examiner* — Christopher R Legendre
(74) *Attorney, Agent, or Firm* — Cantor Colburn LLP

(57) ABSTRACT

In exemplary embodiments, a nozzle can include a first flow wall, a second flow wall and a vane disposed between the first and second flow walls, wherein the vane is mechanically coupled to the first flow wall and in contact with the second flow wall.

19 Claims, 8 Drawing Sheets

TURBINE NOZZLE ASSEMBLY

BACKGROUND OF THE INVENTION

The subject matter disclosed herein relates to gas turbines and more particularly to a nozzle assembly for a gas turbine system.

Gas turbine nozzles are static components of a gas turbine configured to direct heat gas (~2300° F.) in a hot gas path to the rotating portions of the turbine (i.e., to target rotational motion of the rotor). Though significant advances in high temperature capabilities have been achieved, superalloy components must often be air-cooled and/or protected with a coating to exhibit a suitable service life in certain sections of gas turbine engines, such as the airfoils In order to withstand high temperatures produced by combustion, the airfoils in the turbine are cooled. Cooling the airfoils presents a parasitic loss to the power plant as the air that is used to cool the parts has to be compressed but the amount of useful work that can be extracted is comparatively small. As such, it is desirable to cool these parts with as low flow of air as possible to allow for efficient operation of the turbine. The cooling air required can be reduced by using more advanced materials that can withstand the high temperature conditions in the flowpath. These materials tend to be orders of magnitude more expensive than the current super Nickel alloys, or can be very difficult to manufacture in the required shape of a conventional nozzle system. Materials such as ceramics and single crystal super alloys can increase gas turbine efficiency because their properties allow low to no cooling requirements. However, these materials can increase costs and often are unable to meet life requirements.

BRIEF DESCRIPTION OF THE INVENTION

According to one aspect of the invention, a nozzle is disclosed. In exemplary embodiments, the nozzle can include a first flow wall, a second flow wall and a vane disposed between the first and second flow walls, wherein the vane is mechanically coupled to the first flow wall and in contact with the second flow wall.

According to another aspect of the invention, a nozzle assembly is disclosed. In exemplary embodiments, the nozzle assembly can include a nozzle vane segment, a nozzle structural segment disposed adjacent the nozzle vane segment and an interstage seal carrier supported by the nozzle structural segment.

According to yet another aspect of the invention, a nozzle segment. In exemplary embodiments, the nozzle segment can include a first flow wall, a boss disposed on the first flow wall, a second flow wall of the first material; and a vane being a dissimilar material from the first and second flow walls, mechanically coupled to the first flow wall via the boss, and in contact with the second flow wall.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
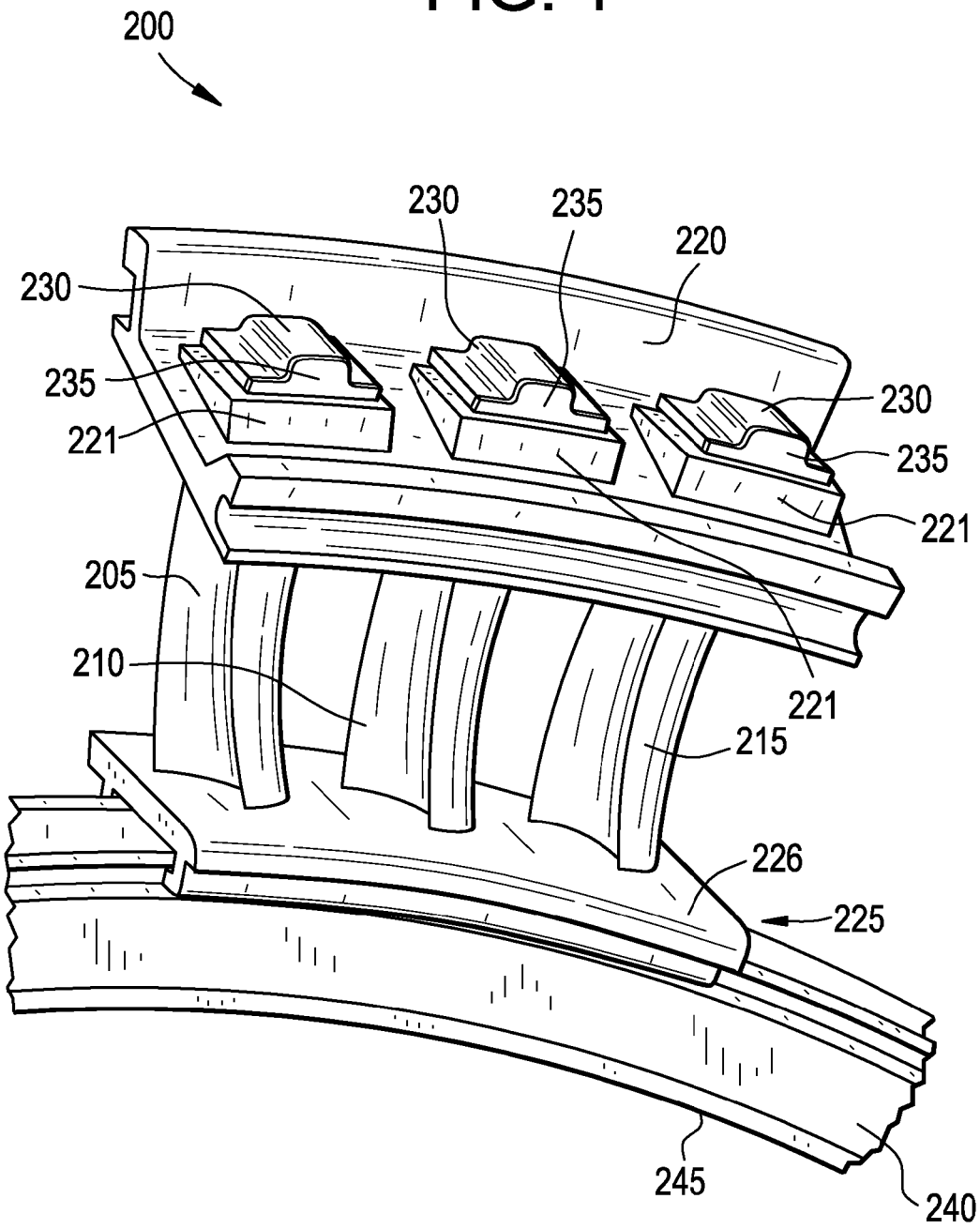
FIG. 1 illustrates a view of an exemplary nozzle vane segment.

FIG. 1 illustrates a view of an exemplary nozzle vane segment 200. The nozzle vane segment 200 (nozzle) can include several vanes 205, 210, 215. Three vanes 205, 210, 215 are shown for illustrative purposes. In other exemplary embodiments, fewer or more vanes are contemplated. The nozzle segment 200 can further include a first (e.g., outer) flow wall 220 and a second (e.g., inner) flow wall 225. As described further herein, the vanes 205, 210, 215 are mechanically coupled to the first flow wall 220 and in mechanical contact with a surface 226 the inner second flow wall 225. As such, the vanes 205, 210, 215 are cantilevered, being supported by the first flow wall 220. In addition, the vanes 205, 210, 215 are composed of a dissimilar material from the first and second flow walls 220, 225. In exemplary embodiments, the vanes 205, 210, 215 can be ceramic or ceramic matrix composite (CMC) material, and the first and second flow walls 220, 225 can be metallic (e.g., a superalloy such as a Ni alloy). As such, the vanes 205, 210, 215 are decoupled from the first and second flow walls 220, 225 such that the vanes 205, 210, 215 are not rigidly connected to the first and second flow walls 220, 225, as compared to the prior art, in which vanes and flow walls are typically a single integral metallic piece. The vanes 205, 210, 215 and the first and second flow walls 220, 225 are therefore mechanically and thermally separated, due in part, because the vanes 205, 210, 215 and the first and second flow walls 220, 225 are dissimilar materials. In addition, the vanes 205, 210, 215 are not structural members of the vane array of which the segment 200 forms a part. Thermal stresses typically present at interfaces between vanes and flow walls that are single integral pieces are therefore reduced. While the vanes 205, 210, 215 are mechanically coupled to the first flow wall 220 and in contact with the second flow wall 225, the mechanical arrangement of the nozzle segment 200 withstands the thermal stresses from the hot gas path through the vanes 205, 210, 215. For example, the airfoil aero load is the only reacted force, and is seen as a bending stress on the vanes 205, 210, 215. In other exemplary embodiments materials other than CMC are also contemplated to address the temperature/stress requirements of the system including the segment 200.

In exemplary embodiments, the nozzle vane segment 200 can further include a vane plug 230 and end cap 235 disposed on each of the vanes 205, 210, 215. The vane plug 230 and the end cap 235 are mechanically coupled to the respective vane 205, 210, 215 as further described herein, and rigidly coupled to the first flow wall 220 (e.g., via welding). In exemplary embodiments, the vane plug 230 and the end cap 235 are also coupled to each other (e.g., via welding), and are coupled to a boss 221 on the first flow wall 220 (e.g., via welding or brazing). In exemplary embodiments, the vane plug 230 and the end cap 235 are a similar metallic material as the first and second flow walls 220, 225. In this way, as described above, the vanes 205, 210, 215 are mechanically coupled to the first flow wall 220. In addition, by welding the vane plug 230 and the end cap 235 to the boss 221, a seal is created isolating the air flow within the vanes 205, 210, 215 and the hot turbine flowpath external to the vanes 205, 210, 215.

In exemplary embodiments, the nozzle vane segment 200 can further include an interstage seal carrier 240 and an interstage seal 245. Prior art nozzles typically carry their own interstage seal carrier. In exemplary embodiments, the second flow wall 225 is coupled to the interstage seal carrier 240. However, the vanes 205, 210, 215 are coupled to the second flow wall by mechanical contact, but do not support the second flow wall 225 or the interstage seal carrier 240. As further described with respect to FIG. 2, the interstage seal carrier 240 is supported by a separate exemplary structure. In exemplary embodiments, the interstage seal carrier is any material suitable to carry the interstage seal, including, but not limited to stainless steel. The interstage seal 245 can be any suitable seal including, but not limited to, a honeycomb seal.

Figure 2:
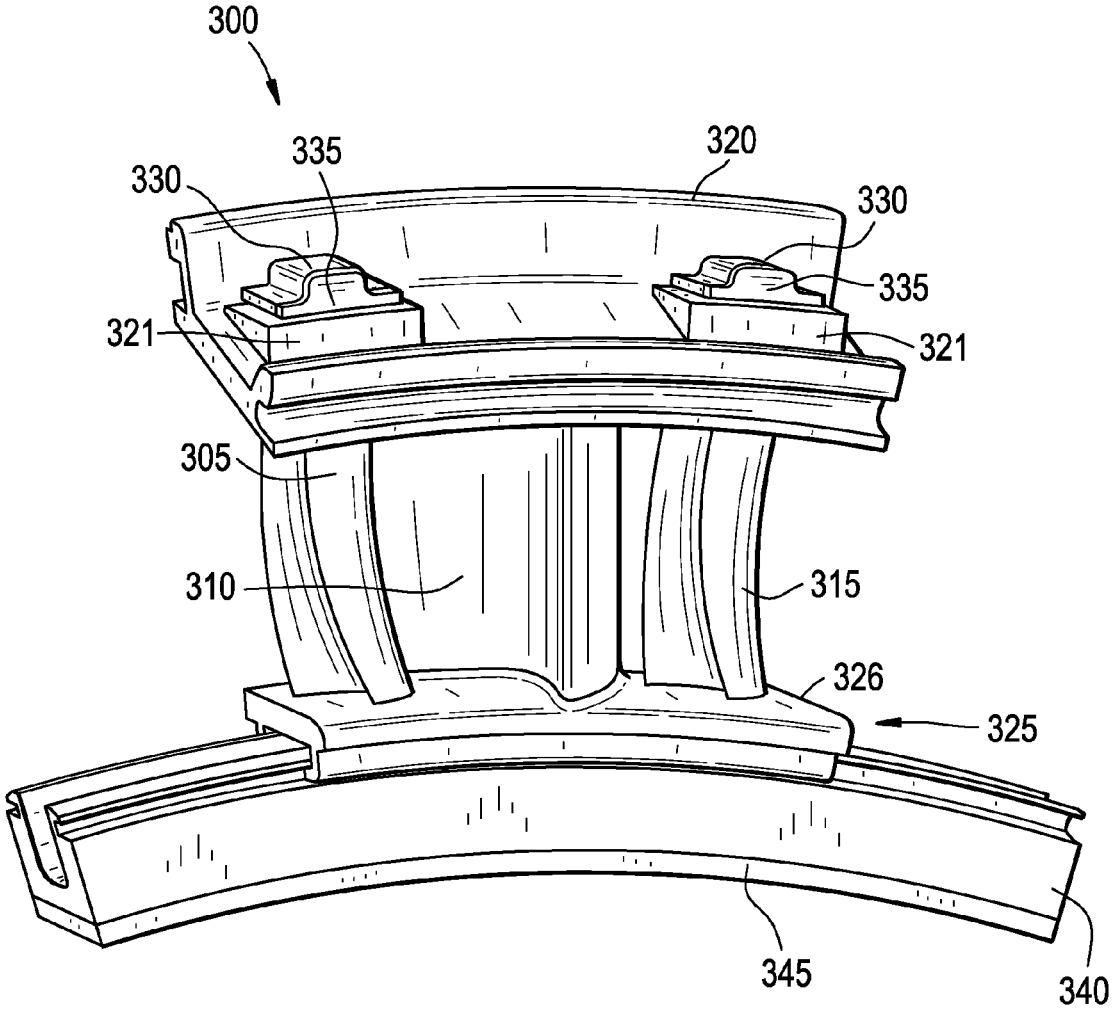
FIG. 2 illustrates a view of an exemplary nozzle structural segment.

FIG. 2 illustrates a view of an exemplary nozzle structural segment 300. The nozzle vane segment 300 can include several vanes 305, 315. Two vanes 305, 315 are shown for illustrative purposes. In other exemplary embodiments, fewer or more vanes are contemplated. The nozzle structural segment 300 can further include a first (e.g., outer) flow wall 320 and a second (e.g., inner) flow wall 325. In addition, nozzle structural segment 300 can further include a strut vane 310. As described further herein, the vanes 305, 315 are mechanically coupled to the first flow wall 320 and in mechanical contact with a surface 326 of the inner second flow wall 325. As such, the vanes 305, 315 are cantilevered, being supported by the first flow wall 320. In addition, the vanes 305, 315 are composed of a dissimilar material from the first and second flow walls 320, 325. In exemplary embodiments, the vanes 305, 315 can be ceramic or CMC material, and the first and second flow walls 320, 325 can be metallic (e.g., a superalloy such as a Ni, Co and Fe superalloys). As such, the vanes 305, 315 are decoupled from the first and second flow walls 320, 325, as compared to the prior art, in which vanes and flow walls are typically a single integral metallic piece. The vanes 305, 315 and the first and second flow walls 320, 325 are therefore mechanically separated. In this way, the vanes 305, 315 are not structural members of the vane array in which the segment 300 is part. Thermal stresses typically present at interfaces between vanes and flow walls are therefore reduced. While the vanes 305, 315 are mechanically coupled to the first and second flow walls 320, 325, the mechanical couplings withstand the thermal stresses from the hot gas path through the vanes 305, 315. In contrast, the strut vane 310 can be a similar or the same material as the first and second flow walls 320, 325. For example, as described above, the first and second flow walls 320, 325 can be metallic. Similarly, the strut vane 310 can be metallic. In exemplary embodiments, the first and second flow walls 320, 325 and the strut vane 310 can be a single integral piece. In exemplary embodiments, the strut vane 310 can be cooled by injection of wheelspace purge air. The double use of this air, for cooling the structural vanes and then for purging the wheelspace cavity allows the airfoil system, in which the nozzle structural segment 300 is part, to have a net 0% cooling flow requirement, which simplifies the system and adds performance to the cycle.

In exemplary embodiments, the nozzle structural segment 300 can further include a vane plug 330 and end cap 335 disposed on each of the vanes 305, 315. The vane plug 330 and the end cap 335 are mechanically coupled to the respective vane 305, 315 as further described herein, and rigidly coupled to the first flow wall 320 (e.g., via welding). In exemplary embodiments, the vane plug 330 and the end cap 335 are also coupled to each other (e.g., via welding), and are coupled to a boss 321 on the first flow wall 320 (e.g., via welding). In exemplary embodiments, the vane plug 330 and the end cap 335 are a similar metallic material as the first and second flow walls 320, 325, and the strut vane 310. As described above, the vanes 305, 315 are mechanically coupled to the first flow wall 320.

In exemplary embodiments, the nozzle structural segment 300 can further include an interstage seal carrier 340 and an interstage seal 345. In exemplary embodiments, the interstage seal carrier 340 and an interstage seal 345 are arranged contiguously with the interstage seal carrier 240 and the interstage seal 245 of FIG. 1. Similarly, various nozzle structural segments 300 are arranged contiguously with several nozzle vane segments 200. As described above, prior art nozzles typically carry their own interstage seal carrier. In addition, the nozzle vane segment 200 does not support the interstage seal carrier 240. However, the nozzle structural segment 300 does support the interstage seal carrier 340. As described above, the first and second flow walls 320, 325 and the strut vane 310 are a single integral piece. As such, the second flow wall is coupled to the interstage seal carrier 340, and the first flow wall 320 is coupled to the turbine casing (not shown). Therefore, the nozzle structural segment 300 supports the interstage seal carrier 340. In exemplary embodiments, the interstage seal carrier 340 is any material suitable to carry the interstage seal, including, but not limited to stainless steel. The interstage seal 345 can be any suitable seal including, but not limited to, a honeycomb seal.

Figure 3:
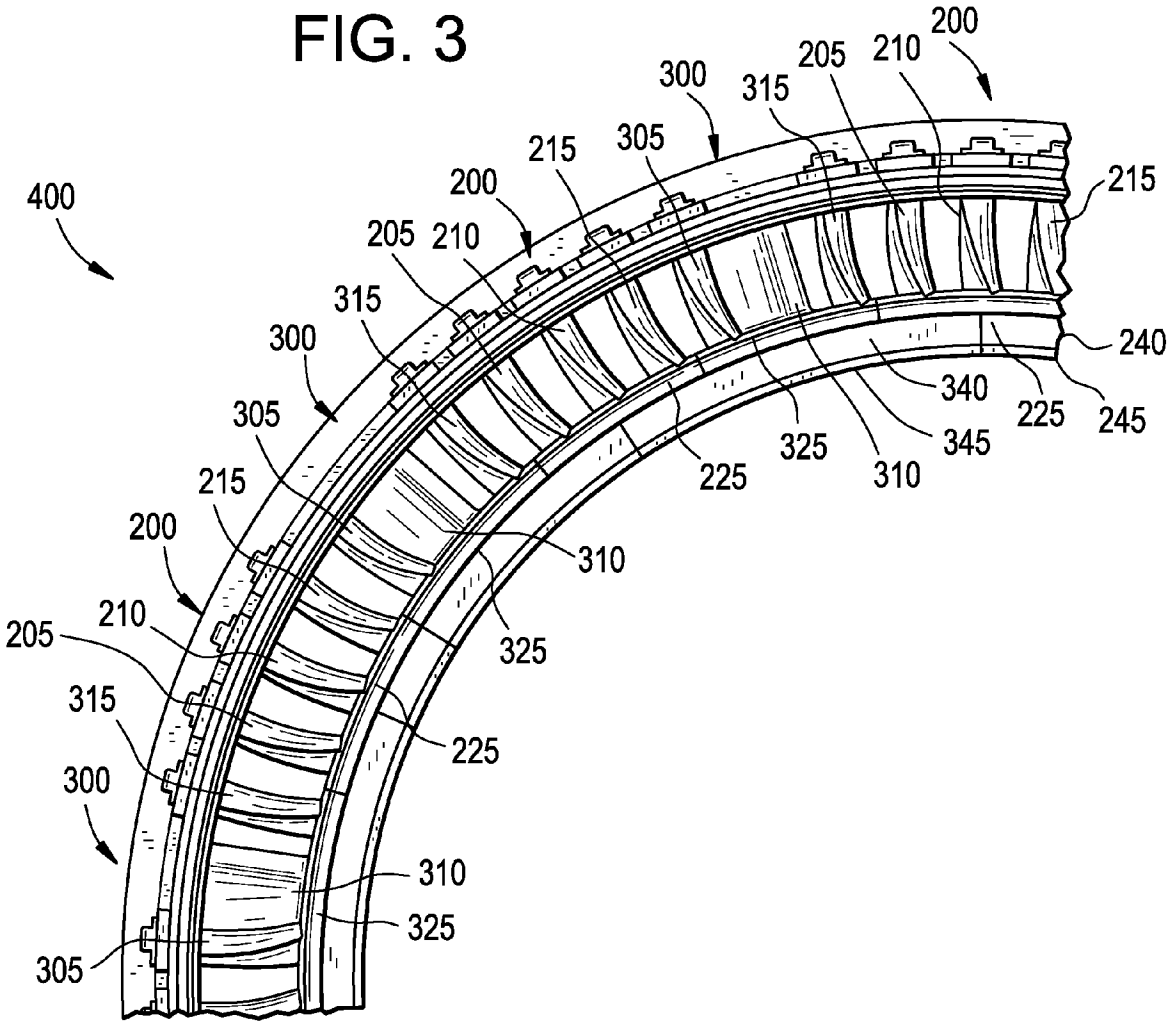
FIG. 3 illustrates an exemplary nozzle assembly, illustrating an alternating arrangement of the exemplary nozzle vane segments of FIG. 1 and the exemplary nozzle structural segments of FIG. 2.

FIG. 3 illustrates an exemplary nozzle assembly 400, illustrating an arrangement of the exemplary nozzle vane segments 200 of FIG. 1 and the exemplary nozzle structural segments 300 of FIG. 2. FIG. 3 illustrates that a majority of vanes 205, 210, 215, 305, 315 are cantilevered without any connection to the second flow walls 225, 325 of the respective segment 200, 300. As described above, the vanes 205, 210, 215, 305, 315 contact a respective surface 226, 326 of the respective second flow walls 225, 325. In addition, the strut vanes 310 are connected to both the first and second flow walls 320, 325. In exemplary embodiments, the strut vanes 310 are mechanically connected to the first and second flow walls 320, 325 either as an integral piece or via welding or other suitable coupling method.

FIG. 3 further illustrates the interstage seal carrier 240, 340 and interstage seal 245, 345 as described with respect to FIGS. 1 and 2. In exemplary embodiments, the interstage seal carrier 340 and an interstage seal 345 are arranged contiguously with the interstage seal carrier 240 and the interstage seal 245 of FIG. 1. In exemplary embodiments, the interstage seal carrier 240, 340 can include two halves for ease of disassembly in an industrial turbine environment. The interstage seal carrier carries the second flow walls 225, 325 by various mechanical attachments, including but not limited to bolts.

As described herein, exemplary embodiments include the exemplary nozzle vane segments 200 of FIG. 1 and the exemplary nozzle structural segments 300 of FIG. 2. By including the two different segments 200, 300 in the entire nozzle assembly 400, the nozzle structural segment 300 can carry the interstage seal carrier 240, 340, coupling the interstage seal carrier 240, 340 to the surrounding casing of the turbine system. As described herein, the vanes 205, 210, 215 of the segment 200 mechanically connect to the first flow wall 220, but remain decoupled as now described.

Figure 4:
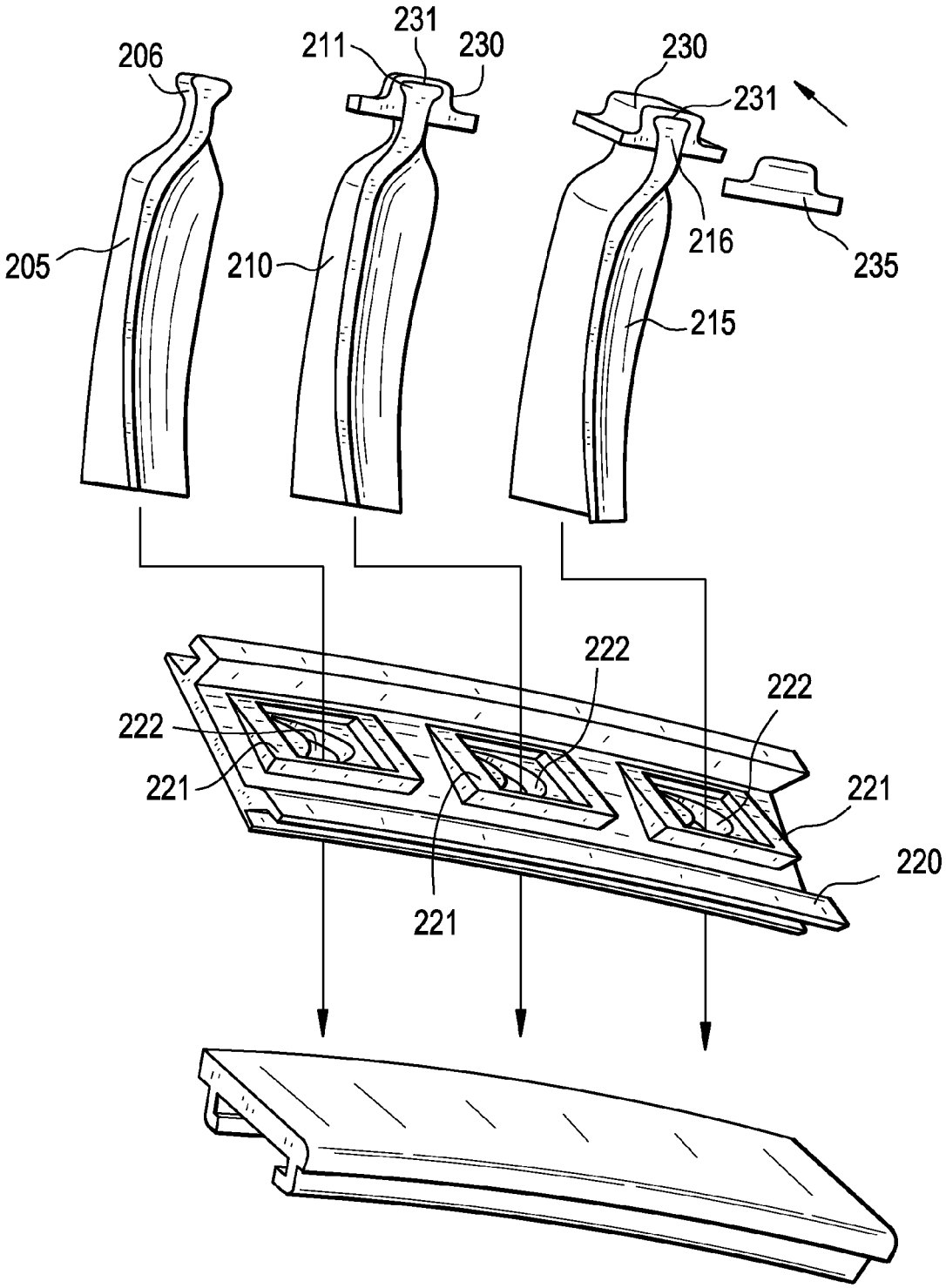
FIG. 4 illustrates an exploded view of the exemplary nozzle vane segment of FIG. 1.
Figure 5:
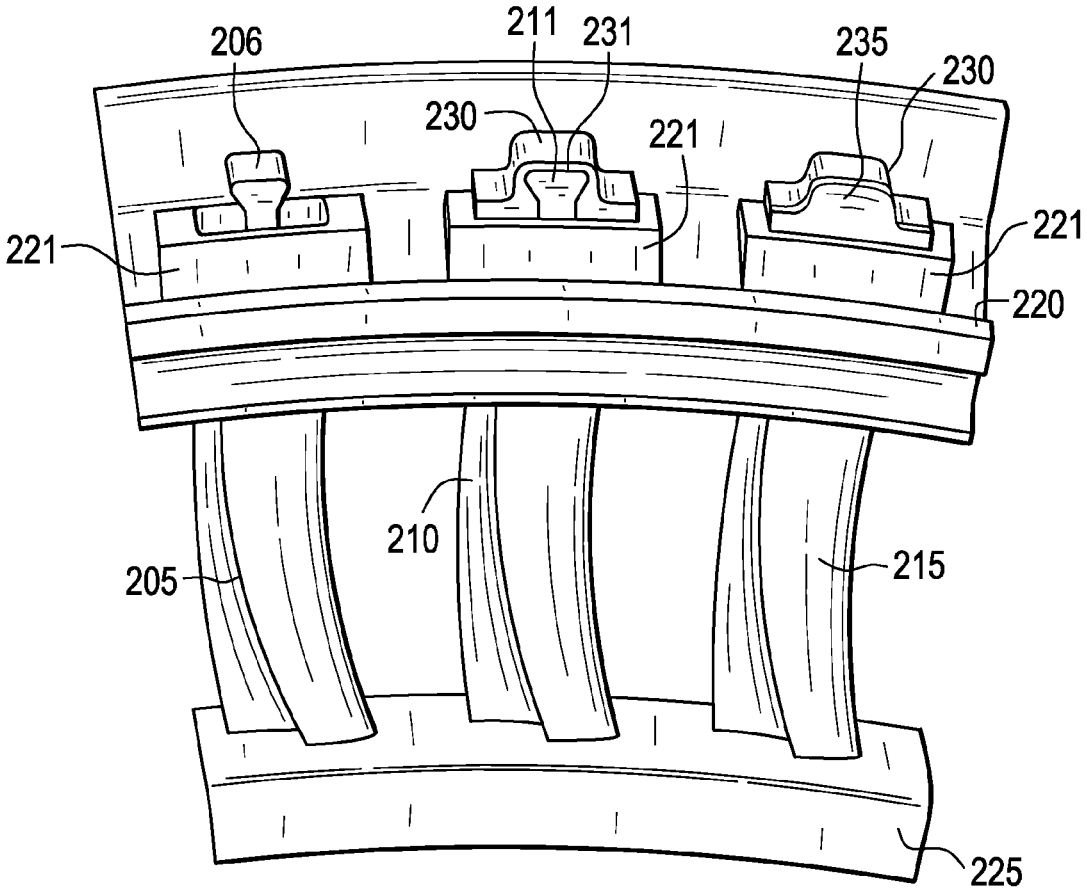
FIG. 5 illustrates a view of the exemplary nozzle vane segment of FIGS. 1 and 4 in a partially assembled state.

FIG. 4 illustrates an exploded view of the exemplary nozzle vane segment 200 of FIG. 1. FIG. 5 illustrates a view of the exemplary nozzle vane segment 200 of FIGS. 1 and 4 in a partially assembled state. The nozzle vane segment 200 can include several vanes 205, 210, 215. The nozzle vane segment 200 further includes the first and second flow walls 220, 225. As described herein, the vanes 205, 210, 215 are mechanically coupled to the first flow wall 220 and in mechanical contact with a surface 226 the inner second flow wall 225, when the segment 200 is fully assembled. As such, the vanes 205, 210, 215 are decoupled from the first and second flow walls 220, 225 such that the vanes 205, 210, 215 are not rigidly connected to the first and second flow walls 220, 225, as compared to the prior art, in which vanes and flow walls are typically a single integral metallic piece. In exemplary embodiments, each of the vanes 205, 210, 215 includes an axial dovetail 206, 211, 216. In addition, each of the vane plugs 230 includes an aperture 231 that slidably affixes to the respective axial dovetail 206, 211, 216. Once the vane plug 230 is slidably affixed to the respective axial dovetail 206, 211, 216, the end cap 235 can be connected (e.g., welding) to each of the vane plugs 230. In exemplary embodiments, a boss aperture 222 is defined within each boss 221 on the first flow wall 220. In exemplary embodiments, the boss apertures 221 match the respective profile of each of the vanes 205, 210, 215 such that the vanes 205, 210, 215 can slide through the boss apertures 222. Each of the vane plugs 230 are wider than the boss apertures 222 such that when the vanes 205, 210, 215 slide through the boss apertures 222, the vane plugs do not pass and are flush with the bosses 221. As described herein, the end caps 235 can be welded to the vane plugs 230, and the end caps 235 and vane plugs 230 can be welded to the bosses 221.

As such, the axial dovetails 206, 211, 216 sit and are free to expand and contract within the vane plugs 230. Therefore, there are no stresses caused by a rigid connection such as welding between vanes and flow walls of similar material such as in the prior art. However, the vanes 205, 210, 215 are secured to the flow wall 220 via the rigid connection between the vane plugs 230, end cap 235 and boss 221 (e.g., via welding). As described above, the vanes 205, 210, 215 and the first and second flow walls 220, 225 are therefore mechanically and thermally separated because the vanes 205, 210, 215 and the first and second flow walls 220, 225 are dissimilar materials from one another. In addition, the vanes 205, 210, 215 are not structural members of the vane array in which the segment 200 is part. Thermal stresses typically present at interfaces between vanes and flow walls that are single integral pieces are therefore reduced or eliminated. While the vanes 205, 210, 215 are mechanically coupled to the first flow wall 220 and in contact with the second flow wall 225, the mechanical arrangement of the nozzle segment 200 withstands the thermal stresses from the hot gas path through the vanes 205, 210, 215.

Figure 6:
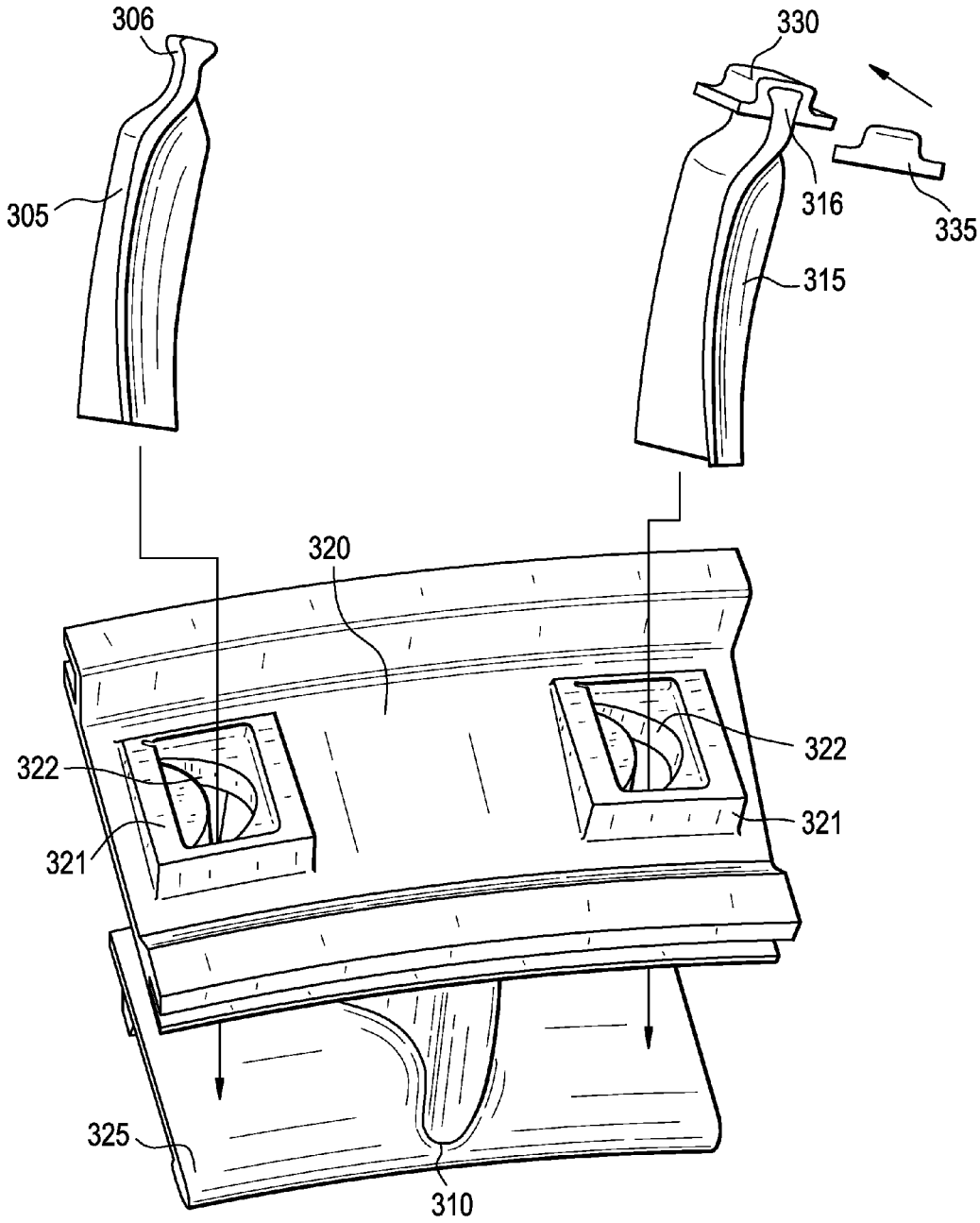
FIG. 6 illustrates an exploded view of an exemplary nozzle structural segment.

FIG. 6 illustrates an exploded view of an exemplary nozzle structural segment 300. As described above, the nozzle structural segment 300 includes the first and second flow walls 320, 325, which can be a single integral piece with the strut vane 310. FIG. 6 illustrates that the vanes 305, 315 can slide through the boss apertures 322 similarly to the assembly techniques discussed above. Vane plugs 330 can be slidably affixed to axial dovetails 306, 316, and the end caps 335 can be connected (e.g., welded) to the vane plugs 330. The vane plugs 330, end caps 335 and bosses 321 can all be rigidly connection to each other via a suitable technique such as, but not limited to, welding.

Figure 7:
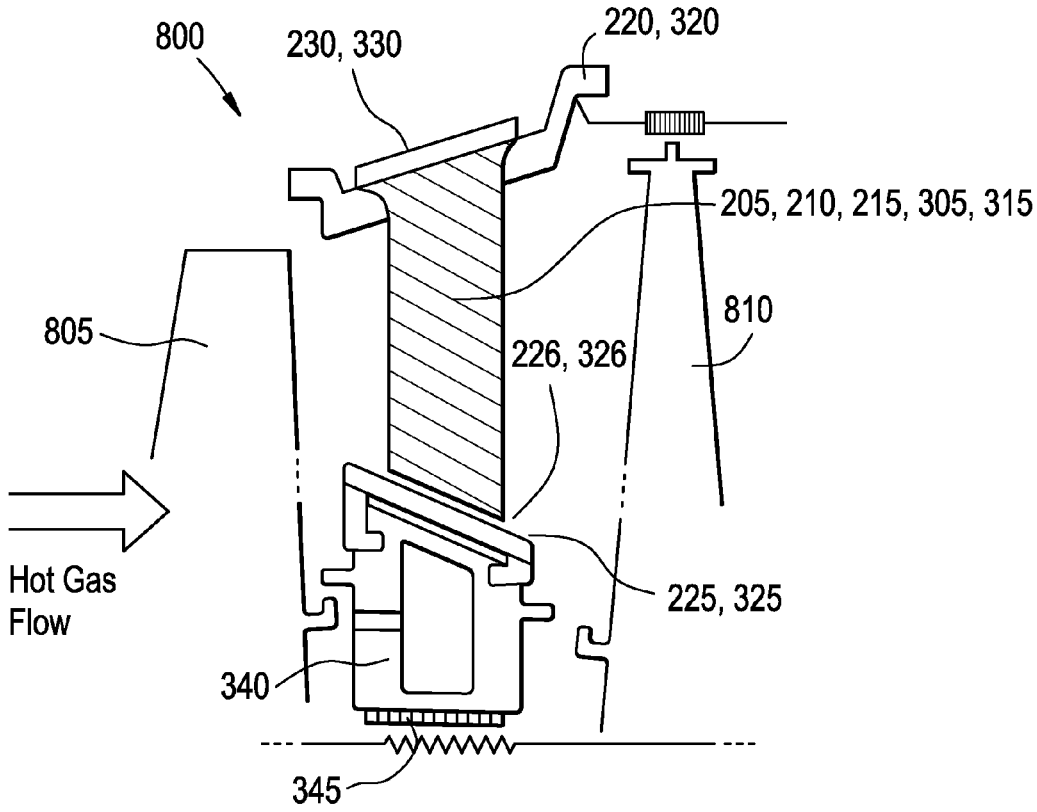
FIG. 7 illustrates a cross-sectional side view of one of exemplary vanes in a turbine environment.

FIG. 7 illustrates a cross-sectional side view of one of the vanes 205, 210, 215, 305, 315 in a turbine environment 800. As such, the cross sectional side view can illustrate either the vanes 205, 210, 215 of the nozzle vane segment 200 or the vanes 305, 315 of the nozzle structural segment 300. FIG. 7 illustrates the orientation of the vanes 205, 210, 215, 305, 315 in the turbine environment 800. For illustrative purposes the segment 200, 300 is adjacent two turbine blades 805, 810. FIG. 7 further illustrates the first flow wall 220, 320 and the second flow wall 225, 325, the vane plug, 230, 330, the interstage seal carrier 340, and the interstage seal 345.

Figure 8:
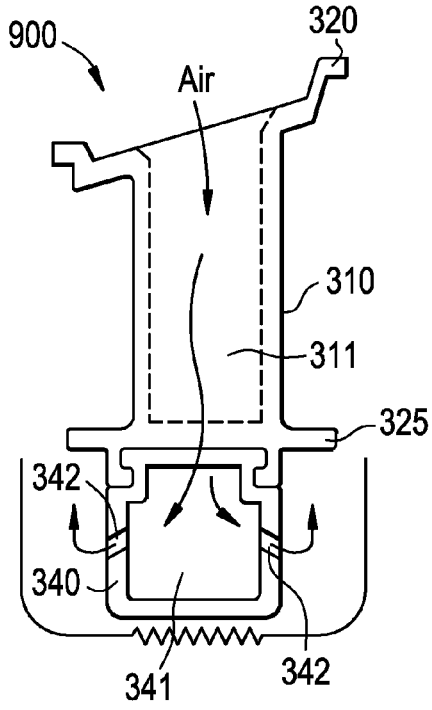
FIG. 8 illustrates a cross-sectional side view of exemplary strut vanes in a turbine environment.

FIG. 8 illustrates a cross-sectional side view of a strut vane 310 in a turbine environment 900. As such, the cross sectional side view of the strut vane 310 of the nozzle structural segment 300. FIG. 8 illustrates the orientation of the strut vane 310 in the turbine environment 900. FIG. 8 further illustrates the first flow wall 320 and the second flow wall 325, and the interstage seal carrier 340. FIG. 8 further illustrates that the strut vane 310 can include and internal air space 311 through which cooling air can flow as described herein. The internal air space 311 can be in fluid communication with an air space 341 in the interstage seal carrier 340 and air purge holes 342.

Figure 9:
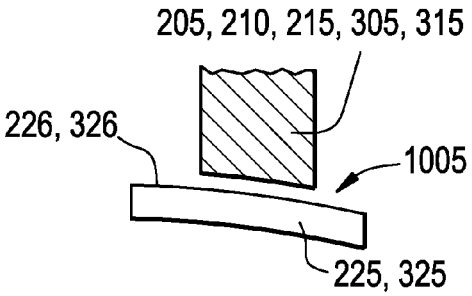
FIG. 9 illustrates a close-up view of a between vanes and respective surfaces in a turbine environment.
Figure 10:
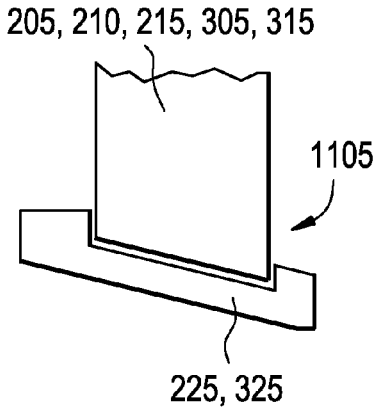
FIG. 10 illustrates an exemplary embodiment of a trench that can be disposed on second flow walls.
Figure 11:
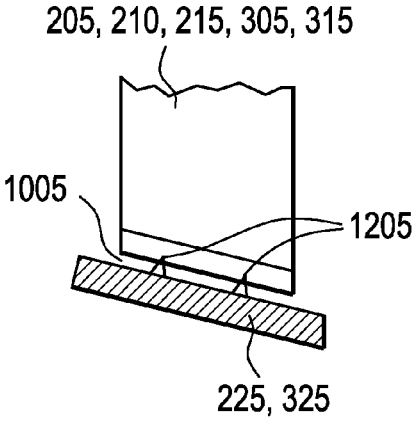
FIG. 11 illustrates an exemplary embodiment of a squealer tip disposed on vanes adjacent second flow walls in a turbine environment.
Figure 12:
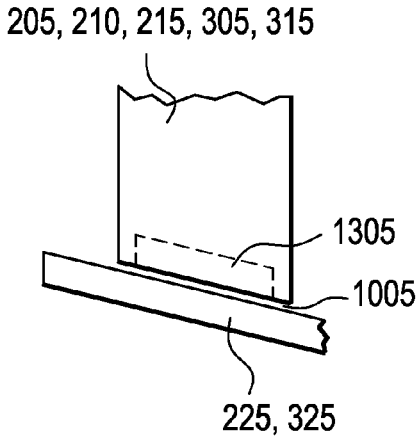
FIG. 12 illustrates an exemplary embodiment of an abradable tip disposed on t vanes adjacent second flow walls in a turbine environment.

Referring again to FIG. 7, as described above, the vanes 205, 210, 215, 305, 315 are in contact with respective surfaces 226, 326 of the second flow walls 225, 325. The mechanical contact may leave a gap at the point of contact. FIG. 9 illustrates a close-up view of a gap 1005 between the vanes 205, 210, 215, 305, 315 and respective surfaces 226, 326. As such, there may be air leakage in the gap 1005, reducing the efficiency of the turbine. Although the gap 1005 can be reduced to reduced air leakage, the gap 1005 can be sensitive to thermal displacements inside the turbine environment. FIGS. 10-12 illustrate only examples implemented to reduce air leakage from the gap 1005. In other exemplary embodiments, other examples are contemplated.

FIG. 10 illustrates an exemplary embodiment of a trench 1105 that can be disposed on the second flow walls 225, 325. The respective vanes 205, 210, 215, 305, 315 can be disposed within the trench 1105, which makes the passage of air more difficult than without the trench 1105, thereby creating a better seal between the second flow wall 225, 325 and the vanes 205, 210, 215, 305, 315.

FIG. 11 illustrates an exemplary embodiment of an abradable tip 1205 disposed on the vanes 205, 210, 215, 305, 315 adjacent the second flow walls 225, 325. The abradable tip 1205 are coatings on the vanes 205, 210, 215, 305, 315 adjacent the second flow walls 225, 325 to create teeth-like structures that retard air movement in the gap 1005. "Abradable" refers to any type of coating that wears off in the event of contact between the vanes 205, 210, 215, 305, 315 and the surfaces 226, 326 of the second flow walls 225, 325. In other exemplary embodiments, other coating can be implemented in conjunction with CMC materials to prevent environmental damage to parts of the turbine.

FIG. 12 illustrates an exemplary embodiment of a squealer tip 1305 disposed on the vanes 205, 210, 215, 305, 315 adjacent the second flow walls 225, 325. In exemplary embodiments, the squealer tip 1305 is a cavity formed in the tip of the vanes 205, 210, 215, 305, 315 adjacent the second flow walls 225, 325. This cavity creates aero effects that retard leakage. As such, the vanes 205, 210, 215, 305, 315 include vane tip geometry enhancements from the cavity (i.e., squealer tip 1305).

Technical effects include a reduction in the cooling requirements of nozzle sections, improving turbine efficiency, while maintaining the cost low as the implementation of ceramics (or other high temperature materials, such as single crystal alloys) is contained to the airfoil section. In addition thermal fight stress is reduced or eliminated because the vanes are disconnected from each other, which allows for the implementation of ceramic materials that can lead to significantly reduced cooling flows.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A nozzle assembly, comprising;
a nozzle vane segment;
a nozzle structural segment disposed adjacent the nozzle vane segment, the nozzle structural segment having:
a first flow wall;
a second flow wall;
a vane disposed between the first and second flow walls; and
a strut vane rigidly disposed between the first and second flow walls,
wherein the vane is mechanically coupled to the first flow wall and in contact with the second flow wall,
wherein the first and second flow walls and the strut vane are a dissimilar material from the vane,
an interstage seal carrier supported by the nozzle structural segment,
a vane plug disposed on the first flow wall,
wherein the vane is mechanically coupled to the vane plug.

2. The nozzle as claimed in claim 1 wherein the vane plug is a similar material to a material of the first and second flow walls.

3. The nozzle as claimed in claim 1 wherein the vane plug is a dissimilar material to a material of the first and second flow walls.

4. A nozzle assembly, comprising:
a nozzle vane segment, having:
a first flow wall;
a second flow wall; and
a vane disposed between the first and second flow walls,
wherein the vane is mechanically coupled to the first flow wall and in contact with the second flow wall,
wherein the first and second flow walls are a dissimilar material from the vane;
a nozzle structural segment disposed adjacent the nozzle vane segment;
an interstage seal carrier supported by the nozzle structural segment; and
a vane plug disposed on the first flow wall,
wherein the vane is mechanically coupled to the vane plug.

5. The nozzle as claimed in claim 4 wherein the vane plug is a similar material to a material of the first and second flow walls.

6. The nozzle as claimed in claim 4 wherein the vane plug is a dissimilar material to a material of the first and second flow walls.

7. A nozzle, comprising:
a first flow wall, having a boss and a boss aperture disposed in the boss;
a second flow wall;
a vane disposed between the first and second flow walls, the vane being mechanically coupled to the first flow wall and in contact with the second flow wall, and the vane having an axial dovetail disposed in the boss aperture;
a vane plug disposed on the boss, wherein the axial dovetail is slidably affixed to the vane plug; and
an end cap disposed on the boss and the vane plug.

8. The nozzle as claimed in claim 7 wherein the first and second flow walls are a first material and the vane is a second material.

9. The nozzle as claimed in claim 8 wherein the first material and the second material are dissimilar.

10. The nozzle as claimed in claim 9 wherein the first material is metallic.

11. The nozzle as claimed in claim 9 wherein the second material is ceramic.

12. The nozzle as claimed in claim 9 wherein the second material is ceramic matrix composite (CMC).

13. The nozzle as claimed in claim 8 wherein the vane plug and the end cap are a similar material to the first material.

14. The nozzle as claimed in claim 8 wherein the vane plug and the end cap are a dissimilar material to the first material.

15. A nozzle segment, comprising:
a first flow wall of a first material;
a boss disposed on the first flow wall;
a second flow wall of the first material;
a vane being a dissimilar material from the first and second flow walls, mechanically coupled to the first flow wall via the boss, and in contact with the second flow wall;
a vane plug disposed on the boss and affixed to the vane; and
an end cap disposed on the boss and the vane plug.

16. The nozzle segment as claimed in claim 15 wherein the first and second flow walls are metallic.

17. The nozzle segment as claimed in claim 16 wherein the vane is a ceramic material.

18. The nozzle segment as claimed in claim 15 further comprising:
a strut vane disposed between the first and second flow walls, being a similar material as the first and second flow walls.

19. The nozzle segment as claimed in claim 18 wherein the strut vane is a metallic material.

* * * * *